US011282473B2

(12) United States Patent
Wang

(10) Patent No.: US 11,282,473 B2
(45) Date of Patent: Mar. 22, 2022

(54) METHOD AND APPARATUS FOR IDENTIFYING RISING/FALLING EDGE AND DISPLAY PANEL

(71) Applicants: HKC Corporation Limited, Guangdong (CN); Chongqing HKC Optoelectronics Technology Co., Ltd., Chongqing (CN)

(72) Inventor: Mingliang Wang, Guangdong (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 7 days.

(21) Appl. No.: 17/031,948

(22) Filed: Sep. 25, 2020

(65) Prior Publication Data

US 2021/0012746 A1 Jan. 14, 2021

Related U.S. Application Data

(63) Continuation of application No. PCT/CN2018/116956, filed on Nov. 22, 2018.

(30) Foreign Application Priority Data

Oct. 8, 2018 (CN) ..... 201811170540.9

(51) Int. Cl.
*G09G 5/00* (2006.01)

(52) U.S. Cl.
CPC ..... *G09G 5/00* (2013.01); *G09G 2310/08* (2013.01); *G09G 2320/02* (2013.01); *G09G 2330/12* (2013.01); *G09G 2370/00* (2013.01)

(58) Field of Classification Search
CPC .. G09G 5/00; G09G 2310/08; G09G 2320/02; G09G 2330/12
USPC ..... 345/213
See application file for complete search history.

(56) References Cited

U.S. PATENT DOCUMENTS

| | | | | |
|---|---|---|---|---|
| 4,226,245 | A | 10/1980 | Bennett, Jr. | |
| 7,206,985 | B2 | 4/2007 | Ostendorf | |
| 8,090,971 | B2 | 1/2012 | Sarmento | |
| 2007/0070245 | A1 | 3/2007 | Yoshizawa | |
| 2015/0358150 | A1* | 12/2015 | Meng | H03M 9/00 375/362 |
| 2017/0353291 | A1* | 12/2017 | Tsai | G06F 13/382 |

FOREIGN PATENT DOCUMENTS

| | | | |
|---|---|---|---|
| CN | 101424709 | A | 5/2009 |
| CN | 102645589 | A | 8/2012 |
| CN | 103728516 | A | 4/2014 |

(Continued)

OTHER PUBLICATIONS

International Search Report of PCT Patent Application No. PCT/CN2018/116956 dated Jun. 27, 2019.

*Primary Examiner* — Jonathan M Blancha

(57) ABSTRACT

Disclosed are a method and an apparatus for identifying a rising/falling edge and a display panel. The method for identifying a rising/falling edge includes the following steps: acquiring a real-time voltage increment of the current signal; determining whether or not a variation mode of the voltage increment is linear variation; and determining that a rising/falling edge of the current signal reaches at current moment.

19 Claims, 3 Drawing Sheets

(56) References Cited

FOREIGN PATENT DOCUMENTS

| | | | |
|---|---|---|---|
| CN | 104655905 | A | 5/2015 |
| CN | 104836553 | A | 8/2015 |
| CN | 106443203 | A | 2/2017 |
| CN | 108154083 | A | 6/2018 |

* cited by examiner

METHOD AND APPARATUS FOR IDENTIFYING RISING/FALLING EDGE AND DISPLAY PANEL

CROSS-REFERENCE OF RELATED APPLICATIONS

The present application is a continuation application of International Application with No. PCT/CN2018/116956, filed on Nov. 22, 2018, which claims the benefit of a Chinese Patent Application with No. 201811170540.9, titled "METHOD AND APPARATUS FOR IDENTIFYING RISING/FALLING EDGE, DISPLAY PANEL AND STORAGE MEDIUM", filed in the National Intellectual Property Administration, PRC on Oct. 8, 2018, the entire contents of which are hereby incorporated by reference.

FIELD OF THE DISCLOSURE

The present disclosure relates to the field of display panel technologies, and in particular, to a method and an apparatus for identifying a rising/falling edge and a display panel.

BACKGROUND OF THE DISCLOSURE

In a digital circuit, the magnitude of a voltage is represented by a logic level, the logic level includes a high level and a low level, a voltage currently smaller than a level jumping value is defined as the low level and a voltage currently greater than the level hopping value as the high level. A time point at which a voltage jumps from a high level to a low level is a falling edge, and a time point at which a voltage jumps from a low level to a high level is a rising edge.

Because transmission lines differ in characteristic impedance, there is a reflection phenomenon during the transmission process of a signal. This results in that a received clock signal is a superposed signal of a reflected signal and an initial clock signal. For example, with the improvement of definition of display panels, differential signal transmission protocols have been popularized, and when receiving a differential signal, a display panel performs data capturing on the differential signal at a rising/falling edge of a clock signal according to a clock information number. However, due to the existence of the reflected signal, the received clock signal is a superposed signal whose signal waveform is ragged, and in the case of a large trough or peak, a receiving terminal wrongly detects the large trough or peak as a rising/falling edge of the clock signal, leading to the implementation of data capturing for the differential signal at an incorrect timing and thus causing the appearance of an error or a noisy point in the display of the display panel.

SUMMARY OF THE DISCLOSURE

A main objective of the present disclosure is to provide a method and apparatus for a rising/falling edge and a display panel to identify a rising/falling edge of a clock signal of a display panel accurately to improve the accuracy of capturing of data in a differential signal and avoid the appearance of an error or a noisy point in the display of the display panel.

To realize the foregoing objective, the present disclosure provides a method for identifying a rising/falling edge, including:

acquiring a real-time voltage increment of a current signal when a voltage of the current signal is equal to a critical voltage;

determining whether or not a variation mode of the voltage increment is linear variation when the real-time voltage increment is equal to a preset threshold value; and determining that a rising/falling edge of the current signal reaches at current moment if the variation mode is linear variation.

Optionally, the method further includes the following step after the step of determining that a rising/falling edge of the current signal reaches at current moment:

performing data capturing on a differential signal within a preset period of time.

Optionally, the differential signal is a transmission protocol.

Optionally, the method further includes the following step after the step of determining whether or not a variation mode of the voltage increment is linear variation when the real-time voltage increment is equal to a preset threshold value:

determining that the rising/falling edge of the clock signal fails to reach at the current moment if the variation mode is nonlinear variation.

Optionally, the method further includes the following step after the step of determining that the rising/falling edge of the current signal fails to reach at the current moment if the variation mode is nonlinear variation:

outputting an error detection signal.

Optionally, the error detection signal is set to indicate whether or not the current rising/falling edge is a rising/falling edge that is not wrongly detected.

Optionally, the method further includes the following step after the step of determining that a rising/falling edge of the current signal reaches at current moment if the variation mode is linear variation:

outputting a rising/falling edge enabling signal.

Optionally, the enabling signal is set to enable a data memory.

Optionally, the data memory is configured to capture data in the differential signal.

Optionally, the step of determining whether or not a variation mode of the voltage increment is linear variation when the real-time voltage increment is equal to a preset threshold value includes:

when the voltage increment is equal to the preset threshold value, determining whether or not the voltage increment increases or decreases gradually by taking the critical voltage as an initial value; and if so, determining whether or not a variation mode of the voltage increment is linear variation.

Optionally, whether or not the voltage increment gradually increases or decreases by taking the critical voltage as an initial value is generally determined using a sampling method.

Optionally, a sampling frequency is a preset sampling frequency.

Optionally, the step of determining whether or not the voltage increment increases or decreases gradually by taking the critical voltage as an initial value includes:

acquiring sample voltages at specific timings, and determining whether or not the voltage increment varies in a gradual increase or decrease manner according to magnitudes of the sample voltages.

Optionally, the current signal is a periodic signal, and a frequency of the current signal is smaller than a sampling frequency at which the sample voltages are acquired.

Optionally, the critical voltage is determined according to an analog-digital conversion jumping voltage.

Optionally, the current signal is a clock signal.

Optionally, the method further includes the following step before the step of acquiring a real-time voltage increment of the current signal when a voltage of the current signal is equal to a critical voltage:

acquiring a voltage value of the current signal in real time.

In addition, to realize the foregoing objective, the present disclosure further provides an apparatus for identifying a rising/falling edge, which includes: a memory, a processor, and an identification program which is stored on the memory and executable on the processor, the identification program, when executed by the processor, realizes the steps included in the foregoing method for identifying a rising/falling edge.

Further, to realize the foregoing objective, the present disclosure also provides a display panel, which includes the foregoing apparatus for identifying a rising/falling edge.

According to the method and apparatus for identifying a rising/falling edge and the display panel disclosed herein, a real-time voltage increment of the current signal is acquired when a voltage of the current signal is equal to a critical voltage, then, whether or not a variation mode of the voltage increment is linear variation is determined when the real-time voltage increment is equal to a preset threshold value, and it is determined that a rising/falling edge of the current signal reaches at current moment if the variation mode is linear variation. The present disclosure can identify a rising/falling edge accurately, and thus can accurately determine a timing for capturing data in a differential signal and consequentially avoid the appearance of an error or a noisy point in the display of a display panel.

The realizing of the objective, functional characteristics, advantages of the present disclosure are further described in detail with reference to the accompanying drawings when read conjunction with the embodiments.

DETAILED DESCRIPTION OF THE EMBODIMENTS

It should be appreciated that the embodiments described herein are merely for explaining the present disclosure, but are not to be construed as limiting the present disclosure.

Main solutions of embodiments of the present disclosure are as follows;

a real-time voltage increment of the current signal is acquired when a voltage of the current signal is equal to a critical voltage;

whether or not a variation mode of the voltage increment is linear variation is determined when the real-time voltage increment is equal to a preset threshold value; and it is determined that a rising/falling edge of the current signal reaches at current moment if the variation mode is linear variation.

In accordance with the method and apparatus for identifying a rising/falling edge and the display panel provided herein, a real-time voltage increment of the current signal is acquired when a voltage of the current signal is equal to a critical voltage, then, whether or not a variation mode of the voltage increment is linear variation is determined when the real-time voltage increment is equal to a preset threshold value; and it is determined that a rising/falling edge of the current signal reaches at current moment if the variation mode is linear variation. The present disclosure can identify a rising/falling edge accurately, and thus can accurately determine a timing for capturing data in a differential signal and consequentially avoid the appearance of an error or a noisy point in the display of a display panel.

Figure 1:
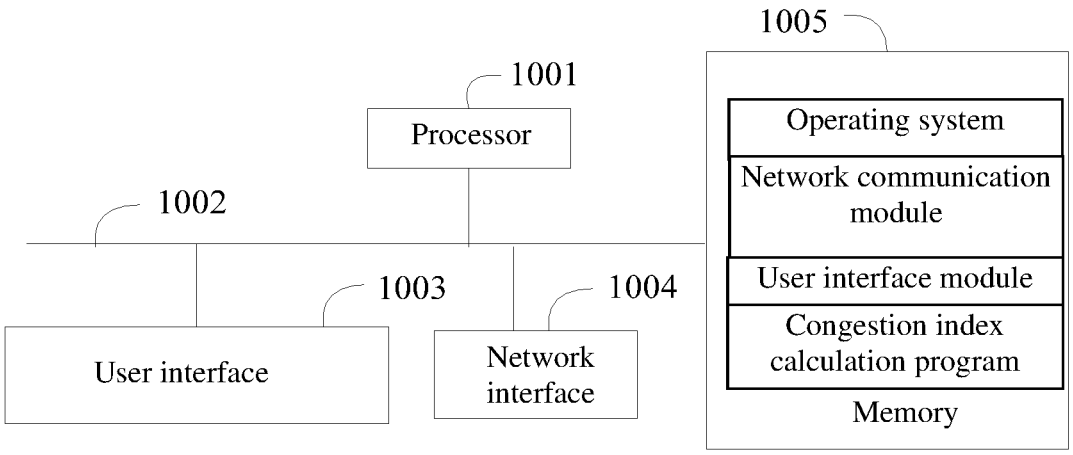
FIG. 1 is a schematic diagram illustrating a structure of a terminal in a hardware running environment involved in a solution of an embodiment of the present disclosure.

FIG. 1 is a schematic diagram illustrating a structure of a terminal in a hardware running environment involved in a solution of an embodiment of the present disclosure.

The terminal used in an embodiment of the present disclosure may be a PC or a portable computer, a smart mobile terminal, a server, or the like.

As shown in FIG. 1, the terminal may include: a processor 1001 (e.g. a CPU), a network interface 1004, a user interface 1003, a memory 1005, and a communication bus 1002. The communication bus 1002 is configured to realize connection and communication between the assemblies. The user interface 1003 may include a display, and an input unit (e.g. a remote control), optionally, the user interface 1003 may further include a standard wired interface, and a wireless interface. The network interface 1004 may optionally include a standard wired interface and a wireless interface (e.g. a WI-FI interface). The memory 1005 can be a high-speed RAM memory, and can also be a non-volatile memory, such as a magnetic disk memory. The memory 1005, alternatively, can also be a storage apparatus independent from the processor 1001.

A person skilled in the art may understand that the structure of the terminal shown in FIG. 1 is not to be construed as limiting the terminal, and the terminal may comprise more or less components as shown in the figure, or have combinations of certain components or different arrangement of components.

As shown in FIG. 1, an operating system, a network communication module, a user interface module and an identification program may be included in the memory 1005 serving as a storage medium of a computer.

In the terminal shown in FIG. 1, the network interface 1004 is mainly configured to be connected with a background server to execute data communication with the background server; the user interface 1003 is mainly configured to be connected with a client (a user terminal) to execute data communication with the client; and the processor 1001 may be configured to invoke an identification program stored on the memory 1005 and execute the following operations of:

acquiring a real-time voltage increment of the current signal when a voltage of the current signal is equal to a critical voltage;

determining whether or not a variation mode of the voltage increment is linear variation when the real-time voltage increment is equal to a preset threshold value; and determining that a rising/falling edge of the current signal reaches at current moment if the variation mode is linear variation.

Figure 2:
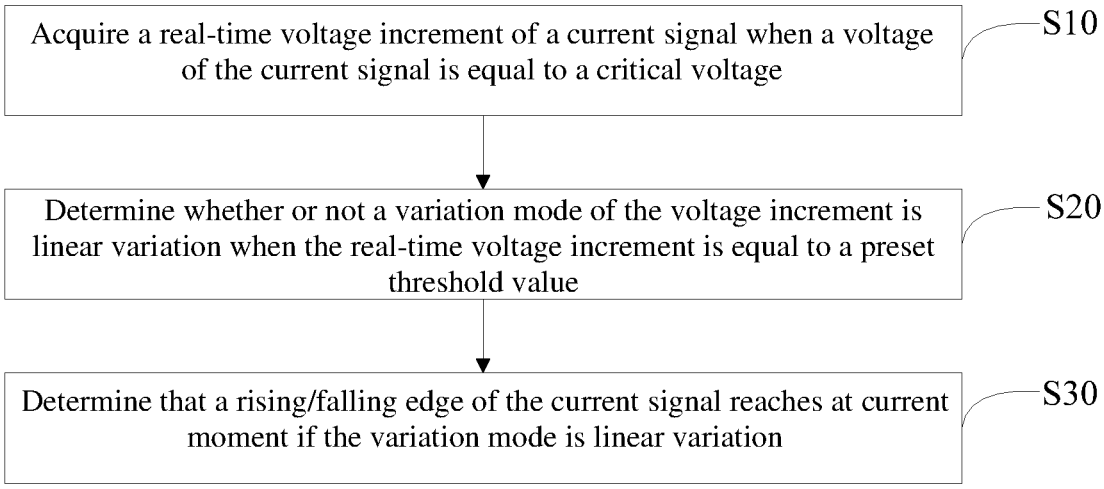
FIG. 2 is a flowchart schematically illustrating a process of identifying a rising/falling edge according to the present disclosure.

Referring to FIG. 2, an embodiment of the method for identifying a rising/falling edge disclosed herein includes the following steps:

step S10: a real-time voltage increment of the current signal is acquired when a voltage of the current signal is equal to a critical voltage;

in the embodiment, an apparatus for identifying a rising/falling edge is capable of monitoring a voltage value of the current signal in real time, and the current signal may be a clock signal or any signal. When the apparatus monitors that a real-time voltage of the current signal is equal to the critical voltage, a real-time increment of the current signal with respect to the critical voltage is acquired. The critical voltage may be determined according to an analog-digital conversion jumping voltage, and in the identification of a rising/falling edge, the critical voltage may be determined according to the following formula:

$$V_{critical}=V_{jumping}\pm k,$$

where $V_{jumping}$ is a jumping voltage between a high level and a low level, and k is a constant, which may be, for example, 0.2. In the identification of a rising edge, the critical edge is equal to the difference between the jumping voltage and the k, and in the identification of a falling edge, the critical edge is equal to the sum of the jumping voltage and the k. For example, in a TTL gate circuit, a voltage above 3.5V is defined as a logic high level and a voltage below 3.5V as a logic low level, that is, a jumping triggering voltage (analog-digital conversion voltage) is 3.5V.

Specifically, when the current signal is a clock signal and the jumping triggering voltage is 3.5V, in the identification a rising/falling edge, the critical voltage is 3.3V/3.7V. After it is monitored that a real-time voltage of the clock signal is equal to 3.3V, a real-time voltage increment of the clock signal with respect to 3.3V is acquired at a time node subsequent to the reaching of the voltage to 3.3V, and it is determined that a rising edge may arrive at the current moment; when it is monitored that the real-time voltage of the clock signal is equal to 3.3V, a real-time voltage increment of the clock signal with respect to 3.7V is acquired at a time node subsequent to the reaching of the voltage to 3.7V, and it is determined that a falling edge may arrive at the current moment.

step S20: whether or not a variation mode of the voltage increment is linear variation is determined when the real-time voltage increment is equal to a preset threshold value;

in the embodiment, because a voltage value of the current signal can be acquired in real time, a real-time increment of the current signal with respect to the critical voltage can be acquired at a moment after the reaching of the voltage value of the current signal to the critical voltage, wherein the real-time increment Δ may be calculated using the following formula:

$$\Delta=|V_{real\text{-}time}-V_{critical}|.$$

The preset threshold value may be 2 k, when the real-time increment Δ is equal to 2 k, the variation mode of the voltage increment is detected, and it is determined whether or not the voltage increment varies linearly from 0 to the preset threshold value 2 k, that is, it is determined whether or not the voltage increment varies gradually.

Specifically, determining whether or not a variation mode of the voltage increment is linear variation refers to determining whether or not the voltage increment increases or decreases gradually by taking the critical voltage as an initial value. For example, as shown in FIG. 7, in the identification of a rising edge, the voltage increment is 0 when the real-time voltage value of the current signal is at a point a, and starting from the point a, the voltage increment increases and increases gradually to 2 k; and in the identification of a falling edge, the voltage increment is 0 at a point b, and starting from the point b, the voltage increment decreases and decreases gradually to −2 k.

Figure 7:
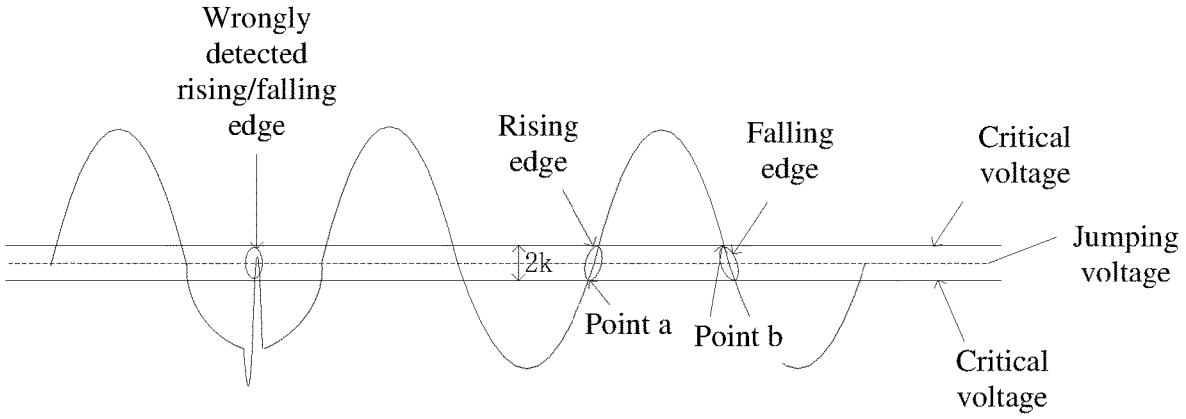
FIG. 7 is a diagram illustrating a waveform of a disturbed clock signal determined in the present disclosure.

It should be noted that whether or not the voltage increment increases/decreases gradually can be determined using a sampling comparison method, take the identification of a rising edge shown in FIG. 7 as example, sample voltages are acquired at specific timings by taking the point a shown in FIG. 7 as a starting point, because a real-time voltage of the current signal can be monitored in real time, a real-time voltage can be acquired at each moment after the point a as a sample voltage. Before the voltage increment reaches 2 k, 100 sample voltages may be acquired at the same time intervals by taking the point a as a starting point.

Alternatively, starting from the second sample voltage, each sample voltage, once acquired, is compared with the former sample voltage, if the currently acquired sample voltage is higher than or equal to a sample voltage acquired at the previous moment, a sample voltage is acquire at the next moment and compared with the current sample voltage, otherwise, it is determined that the voltage increment varies nonlinearly.

Alternatively, 100 sample voltages are acquired, then values of the 100 sample voltages are compared to determine whether or not the values of the 100 sample voltages increase successively, if the values of the 100 sample voltages increase successively, it is determined that the voltage increment varies linearly, otherwise, it is determined that the voltage increment varies nonlinearly.

step S30: if the variation mode is linear variation, it is determined that the current moment reaches the rising/falling edge of the current signal.

In the embodiment, if it is determined that the voltage increment varies linearly, it is determined that the current moment reaches the rising/falling edge of the current signal.

It should be noted that a rising/falling edge enabling signal can be output when it is determined that the current moment reaches the rising/falling edge of the current signal.

In the embodiment, when a real-time voltage of the current signal is equal to the critical voltage, a real-time voltage increment of the current signal is acquired; when the real-time voltage increment is equal to the preset threshold value, whether or not a variation mode of the voltage increment is linear variation is determined, if the real-time voltage increment is equal to the preset threshold value and the variation mode of the voltage increment is linear variation, it is determined that the current moment reaches the rising/falling edge of the current signal, thereby realizing the identification of the rising/falling edge based on the critical voltage, the voltage increment and the variation mode of the voltage increment to allow the rising/falling edge to be identified more accurately.

Figure 3:
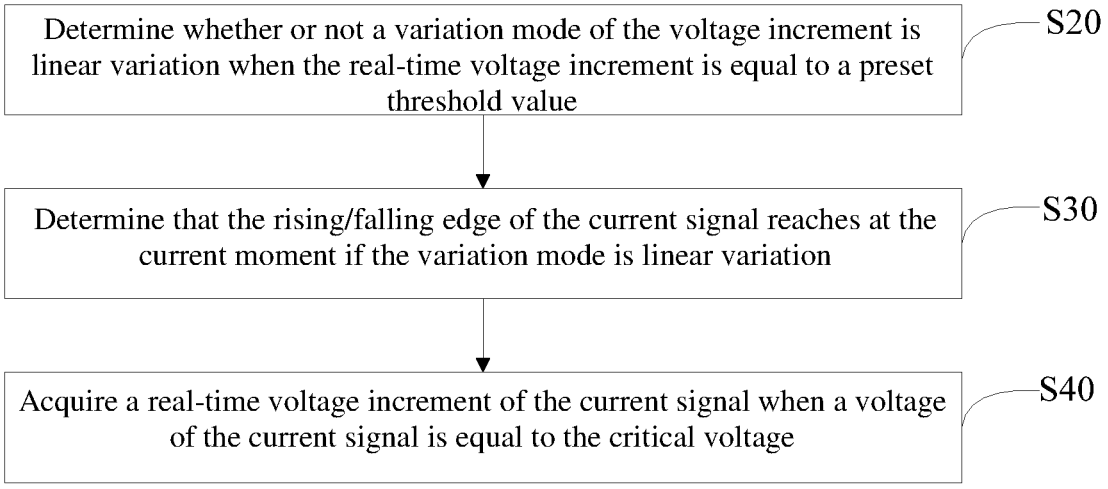
FIG. 3 is a flowchart schematically illustrating a process of acquiring a real-time voltage increment according to the present disclosure.

Further, referring to FIG. 3, based on the foregoing embodiment, an embodiment of the method for identifying a rising/falling edge provided herein further includes the following steps after step S30:

in step S40: data capturing is performed on the differential signal within a preset period of time.

In the embodiment, because the definition of display panels are increasingly improved and contents of television programs become richer and richer, television signals contain more and more contents needing transmitting. Therefore, as a high-speed transmission protocol, differential signal has been popularized.

Differential transmission is a signal transmission technology, which differs from the conventional transmission technology using a signal line and a ground line in transmitting signals on both of a signal line and a ground line, the signals transmitted on the signal line and the ground line have the same amplitude, a phase difference of 180 degrees, and opposite polarities. The signals transmitted on the two lines are differential signals. When performing data capturing on the differential signal, a display panel takes a rising/falling edge of a clock signal as an enabling condition.

On the basis of a first embodiment, the current signal may be a clock signal, and when it is determined that a rising/falling edge of the clock signal occurs at the current moment, a data memory is enabled to perform a data storage action on the differential signal.

In the embodiment, after receiving an enabling signal, the data memory completes the capturing of data in the differential signal within a preset period of time because the differential signal is only stable at the rising/falling edge of the clock signal. When the cycle of the clock signal is T, the preset period of time is T/64.

In the embodiment, a data capturing action is performed on the differential signal within the preset period of time, thus limiting the duration of capturing of data in the differential signal and improving the purity and accuracy of the captured data.

Figure 4:
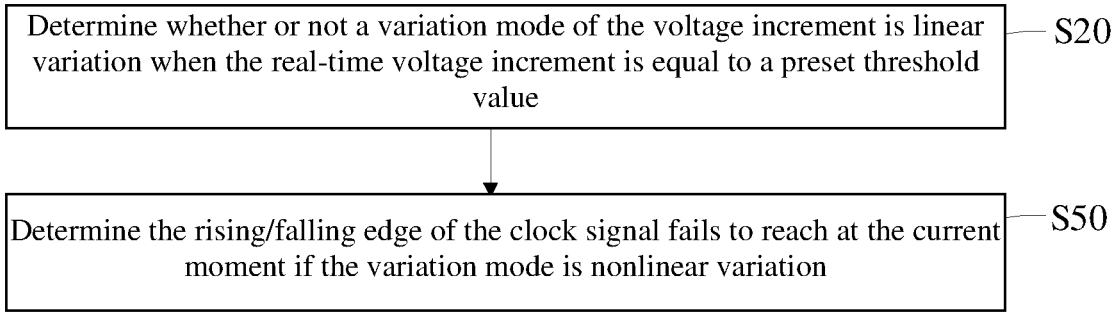
FIG. 4 is a flowchart schematically illustrating a process of determining that the current moment fails to reach a rising/falling edge according to the present disclosure.

Further, referring to FIG. 4, based on the foregoing embodiment, an embodiment of the method for identifying a rising/falling edge disclosed provided further includes the following step after step S20:

step S50: if the variation mode is nonlinear variation, it is determined that the rising/falling edge of the clock signal fails to reach at the current moment.

In the embodiment, when it is detected that the variation mode of the voltage increment is nonlinear variation, a rising edge of the current signal, for example, the wrongly detected rising edge shown in FIG. 7, may be detected at the current moment, at this time, a real rising edge of the current signal actually does not arrive, thus, it is determined that the current moment fails to reach the rising/falling edge.

In addition, an error detection signal is output when it is determined that the current moment fails to reach the rising/falling edge, and when the error detection signal is received by the memory, the memory determines that no rising edge is wrongly detected at the current moment and performs no data capturing action on the differential signal at this time.

In the embodiment, if the variation mode is nonlinear variation, it is determined that the rising/falling edge of the clock signal fails to reach at the current moment, thus avoiding that an error detection of a rising/falling edge causes the memory to capture data in the differential signal and consequentially avoiding the appearance of an error or a noisy point in the display of the display panel.

Figure 5:
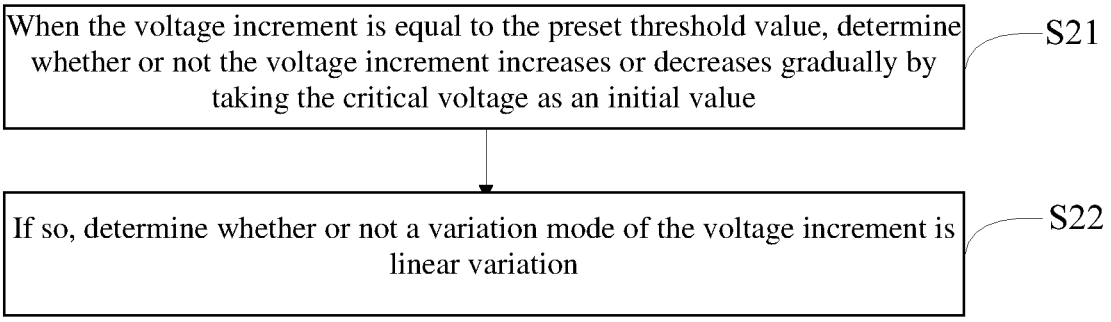
FIG. 5 is a detailed flowchart schematically illustrating a process of determining a variation mode of a voltage increment according to the present disclosure.

Further, referring to FIG. 5, in an embodiment of the method for identifying a rising/falling edge provided herein, which is based on the foregoing embodiment, step S20 includes:

step S21: when the voltage increment is equal to the preset threshold value, it is determined whether or not the voltage increment increases or decreases gradually by taking the critical voltage as an initial value; and step S22: if the voltage increment increases or decreases gradually by taking the critical voltage as an initial value, it is determined whether or not a variation mode of the voltage increment is linear variation.

In the embodiment, as shown in FIG. 7, when the voltage increment is equal to the preset threshold value, it is determined whether or not the voltage increment increases or decreases gradually during the process that the voltage increment varies gradually from the point a or b to the preset threshold value.

For example, as shown in FIG. 7, in the determination of a rising edge, a voltage increment of the current signal is calculated when a voltage amplitude of the current signal reaches the point a shown in FIG. 7, and whether or not the voltage increment increases gradually from a moment corresponding to the point a to the current moment is determined when the voltage increment reaches the preset threshold value.

It should be noted that the voltage increment increases gradually after the rising edge of the current signal arrives, and decreases gradually after the falling edge of the current signal arrives.

When the voltage increases/decreases gradually, it is determined that the voltage increment varies linearly.

In the embodiment, whether or not the voltage increment varies linearly is determined by determining whether or not the voltage increment increases or decreases gradually, which simplifies a determination process and shortens a determination time.

Figure 6:
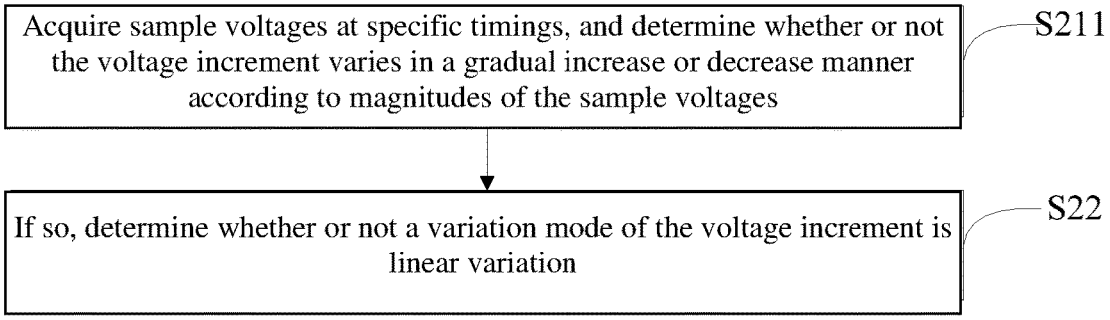
FIG. 6 is a flowchart schematically illustrating a process of determining whether or not a voltage increment increases or decreases gradually.

Further, referring to FIG. 6, in an embodiment of the method for identifying a rising/falling edge provided herein, which is based on the foregoing embodiment, step S21 includes:

step S211: sample voltages are acquired at specific timings, whether or not the voltage increment varies in a gradual increase or decrease manner is determined according to magnitudes of the sample voltages;

In the embodiment, when the voltage increment is equal to the preset threshold value, the voltage increment is sampled at the same time intervals to acquire sample voltages. Then, the sample voltages are compared to determine whether or not the sample voltages increase/decrease gradually in the order of time. If the sample voltages increase/decrease gradually in the order of time, it is determined that the voltage increment increases or decreases gradually.

Further, because a real-time voltage of the current signal can be monitored, a real-time voltage increment can be acquired. Therefore, in the embodiment, a real-time voltage increment can be acquired at specific timings, when the real-time voltage increment is acquired for the second time, the real-time voltage increment acquired for the second time is compared to determine whether or not the real-time voltage increment for the second time is greater than 0. If the real-time voltage increment acquired for the second time is greater than 0, it is determined that a rising edge may arrive, and it is determined whether or not a voltage increment acquired for the third time and those acquired later all meet a condition that the currently acquired voltage increment is higher than that acquired at the previous time (for example, a voltage increment acquired for the third time is greater than that acquired for the second time, and a voltage increment acquired for the fourth time is greater than that acquired for the third time). If the real-time voltage increment acquired for the second time is smaller than 0, it is determined that a falling edge may arrive, and whether or not a voltage increment acquired for the third time and those acquired later all meet a condition that the currently acquired voltage increment is smaller than that acquired at the previous time (for example, a voltage increment acquired for the third time is smaller than that acquired for the second time, and a voltage increment acquired for the fourth time is smaller than that acquired for the third time).

If the condition is met, then it is determined that the voltage increment varies linearly when the voltage increment is equal to the preset threshold value.

In the embodiment, whether or not the voltage increment increases/decreases gradually is determined using a sampling method, thus addressing a problem that it is impossible to determine whether or not a voltage increment increases/decreases gradually.

In addition, the present disclosure further provides an apparatus for identifying a rising/falling edge, which includes: a memory, a processor, and an identification program which is stored on the memory and can be executed on the processor, wherein the identification program, when executed by the processor, realizes the steps of the method for identifying a rising/falling edge described in the foregoing embodiments.

In addition, the present disclosure also provides a display panel, including: an apparatus for identifying a rising/falling edge, which includes: a memory, a processor, and an identification program which is stored on the memory and can be executed on the processor, wherein the identification program, when executed by the processor, realizes the steps of the method for identifying a rising/falling edge described in the foregoing embodiments.

It should be noted that the term "including", "containing" or any variation thereof is intended to encompass non-exclusive inclusion, so that a process, method, article or device including a series of elements includes not only those elements but also other elements not listed explicitly or those elements inherent to such a process, method, article or device. Without more limitations, an element defined by the statement "including a . . . " shall not be precluded to include additional same elements present in a process, method, article or device including the elements.

Those skilled in the art can clearly understand from the description on the foregoing embodiments that the foregoing method embodiments can be realized through software plus a necessary universal hardware platform or merely through hardware, however, the former realization mode is better in most cases. Based on such understanding, the technical solutions of the present disclosure essentially or, in other words, a part thereof contributing to the prior art can be embodied in a form of a software product, wherein the computer software product is stored in, for example, the foregoing storage medium (e.g. an ROM/RAM, a diskette, compact disc) and comprises a plurality of instructions to make one terminal perform the methods as described in respective embodiments of the present disclosure.

The embodiments above are merely preferably embodiments of the present disclosure but are not to be construed as limiting the scope of the present disclosure, and any equivalent structural conversion devised based on the inventive concept of the present disclosure or using the drawing of the present disclosure, or a direct or indirect application of the present disclosure to another related technical field shall fall into the scope of protection of the present disclosure.

What is claimed is:

1. A method for determining a rising/falling edge, comprising the following steps:

acquiring a real-time voltage increment of a current signal when a voltage of the current signal is equal to a critical voltage;

determining whether or not a variation mode of the voltage increment is linear variation when the real-time voltage increment is equal to a preset threshold value; and determining that a rising/falling edge of the current signal reaches at current moment if the variation mode is linear variation.

2. The method for determining a rising/falling edge according to claim 1, wherein the current signal is a clock signal, a data capturing action is performed on a differential signal when a display panel determines that the rising/falling edge of the clock signal reaches at the current moment, and the method further comprises the following step after the step of determining that a rising/falling edge of the current signal reaches at current moment:

performing data capturing on the differential signal within a preset period of time.

3. The method for determining a rising/falling edge according to claim 2, wherein the differential signal is a transmission protocol.

4. The method for determining a rising/falling edge according to claim 2, further comprising the following step after the step of determining whether or not a variation mode of the voltage increment is linear variation when the real-time voltage increment is equal to a preset threshold value:

determining that the rising/falling edge of the clock signal fails to reach at the current moment if the variation mode is nonlinear variation.

5. The method for determining a rising/falling edge according to claim 4, further comprising the following step after the step of determining that the rising/falling edge of the clock signal fails to reach at the current moment if the variation mode is nonlinear variation:

outputting an error detection signal.

6. The method for determining a rising/falling edge according to claim 5, wherein the error detection signal is set to indicate whether or not the current rising/falling edge is a rising/falling edge that is not wrongly detected.

7. The method for determining a rising/falling edge according to claim 2, further comprising the following step after the step of determining that a rising/falling edge of the current signal reaches at current moment if the variation mode is linear variation:

outputting a rising/falling edge enabling signal.

8. The method for determining a rising/falling edge according to claim 7, wherein the enabling signal is set to enable a data memory.

9. The method for determining a rising/falling edge according to claim 8, wherein the data memory is configured to capture data in the differential signal.

10. The method for determining a rising/falling edge according to claim 1, wherein the step of determining whether or not a variation mode of the voltage increment is linear variation when the real-time voltage increment is equal to a preset threshold value comprises:

when the voltage increment is equal to the preset threshold value, determining whether or not the voltage increment increases or decreases gradually by taking the critical voltage as an initial value; and in response to a determination that the voltage increment increases or decreases gradually, determining whether or not a variation mode of the voltage increment is linear variation.

11. The method for determining a rising/falling edge according to claim 10, wherein whether or not the voltage increment gradually increases or decreases by taking the critical voltage as an initial value is generally determined using a sampling method.

12. The method for determining a rising/falling edge according to claim 11, wherein a sampling frequency is a preset sampling frequency.

13. The method for determining a rising/falling edge according to claim 10, wherein the step of determining whether or not the voltage increment increases or decreases gradually by taking the critical voltage as an initial value comprises:

acquiring sample voltages at specific timings, and determining whether or not the voltage increment varies in a gradual increase or decrease manner according to magnitudes of the sample voltages.

14. The method for determining a rising/falling edge according to claim 13, wherein the current signal is a periodic signal, and a frequency of the current signal is smaller than a sampling frequency at which the sample voltages are acquired.

15. The method for determining a rising/falling edge according to claim 1, wherein the critical voltage is determined according to an analog-digital conversion jumping voltage.

16. The method for determining a rising/falling edge according to claim 1, wherein the current signal is a clock signal.

17. The method for determining a rising/falling edge according to claim 1, further comprising the following step before the step of acquiring a real-time voltage increment of the current signal when a voltage of the current signal is equal to a critical voltage:

acquiring a voltage value of the current signal in real time.

18. An apparatus for determining a rising/falling edge, comprising: a memory, a processor, and an identification program which is stored on the memory and executable on the processor, wherein the identification program, when executed by the processor, realizes the following steps:

acquiring a real-time voltage increment of a current signal when a voltage of the current signal is equal to a critical voltage;

determining whether or not a variation mode of the voltage increment is linear variation when the real-time voltage increment is equal to a preset threshold value; and determining that a rising/falling edge of the current signal reaches at current moment if the variation mode is linear variation.

19. A display panel, comprising: an apparatus for identifying a rising/falling edge, wherein, the apparatus for identifying a rising/falling edge comprises: a memory, a processor, and an identification program which is stored on the memory and executable on the processor, the identification program, when executed by the processor, realizes the following steps:

acquiring a real-time voltage increment of a current signal when a voltage of the current signal is equal to a critical voltage;

determining whether or not a variation mode of the voltage increment is linear variation when the real-time voltage increment is equal to a preset threshold value; and determining that a rising/falling edge of the current signal reaches at current moment if the variation mode is linear variation.

* * * * *